US007305962B2

(12) United States Patent
Nonogaki et al.

(10) Patent No.: US 7,305,962 B2
(45) Date of Patent: Dec. 11, 2007

(54) MOUNTING STRUCTURE FOR ENGINE COVER

(75) Inventors: Haruhiko Nonogaki, Aichi (JP); Itsuro Maeda, Aichi (JP); Yutaka Ogasawara, Aichi (JP); Tatsuo Suzuki, Aichi (JP)

(73) Assignee: Toyoda Gosei Co., Ltd., Aichi-ken (JP)

( * ) Notice: Subject to any disclaimer, the term of this patent is extended or adjusted under 35 U.S.C. 154(b) by 0 days.

(21) Appl. No.: 11/091,594

(22) Filed: Mar. 29, 2005

(65) Prior Publication Data

US 2005/0217634 A1 Oct. 6, 2005

(30) Foreign Application Priority Data

Mar. 31, 2004 (JP) ..... P2004-102707

(51) Int. Cl.
*F02B 67/06* (2006.01)

(52) U.S. Cl. ..... 123/195 C; 123/195 R; 123/198 E

(58) Field of Classification Search ..... 123/195 R, 123/195 C, 198 E
See application file for complete search history.

(56) References Cited

U.S. PATENT DOCUMENTS 3,656,466 A * 4/1972 Dzus, Jr. ..... 123/198 E
3,941,115 A * 3/1976 Tshida et al. ..... 123/198 E
4,327,680 A * 5/1982 Dauwalder ..... 123/195 C
5,391,212 A * 2/1995 Ernst et al. ..... 55/385.3
5,562,511 A * 10/1996 Blanchard et al. ..... 440/49
5,937,818 A * 8/1999 Kawai et al. ..... 123/198 E
6,684,843 B1 * 2/2004 Yoshida et al. ..... 123/185.2
6,857,413 B2 * 2/2005 Yamamoto ..... 123/198 E
2003/0019461 A1 1/2003 Yasuda et al.

FOREIGN PATENT DOCUMENTS

JP A-2001-98954 4/2001

* cited by examiner

*Primary Examiner*—Noah P. Kamen
*Assistant Examiner*—Jason Benton
(74) *Attorney, Agent, or Firm*—Posz Law Group, PLC

(57) ABSTRACT

An engine cover mounting structure comprising an engine member and an engine cover, wherein a plurality of portions to be fixed to which fixing portions provided on the engine cover are mounted are provided so as to be situated below an upper surface of a cylinder head cover of the engine member. In addition, a positioning portion is provided on the engine cover. Then, in a state where a base fixing portion is mounted or temporarily mounted to a base portion to be fixed, while the other fixing portions are not mounted to the other portions to be fixed, when the engine cover revolves about the base fixing portion, so that the positioning portion is brought into abutment with a surface of the engine member, the fixing portions other than the base fixing portion are disposed at positions facing the portions to be fixed, respectively.

18 Claims, 4 Drawing Sheets

MOUNTING STRUCTURE FOR ENGINE COVER

This application is based on Japanese Patent Application No. 2004-102707, which is incorporated herein by reference.

BACKGROUND OF THE INVENTION

1. Field of the Invention

The present invention relates to a mounting structure for an engine cover which covers an engine.

2. Related Art

In engine compartments of automobiles in recent years, it becomes a general practice to provide an engine cover above an engine. This engine cover has functions to shield noise that has leaked from the engine (transmitted noise) and to improve the design properties of the interior of the engine compartment by preventing the sight of the engine.

The engine cover is generally mounted to the cylinder head cover of the engine. As this occurs, the engine cover is, in general, mounted to the cylinder head cover through a screw-fastening via bolts (see, for example, JP2001-98954A). Through holes are provided in the engine cover disclosed in JP2001-98954A, and threaded screw-fastening holes are provided in the cylinder head cover to which the engine cover is to be mounted at positions which correspond to the through holes so provided. Then, when the engine cover is mounted to the cylinder head cover, bolts are passed through the through holes from above the engine cover so as to be screwed into the threaded screw-fastening holes, so that the engine cover is mounted to the cylinder head cover by virtue of a fastening force exerted by the threaded screw-fastening holes and the bolts.

In the engine cover mounting structure like this, since the through holes are provided in the engine cover, the mounting work can be performed while confirming the position of the threaded screw-fastening holes through the through holes. Consequently, there is provided an advantage that the mounting work can be facilitated. In contrast, however, since the through holes in the engine cover remain visible from above the engine cover after the mounting of the engine cover, there is caused a problem that the design properties are deteriorated.

In addition, since the mounting of the engine cover to the cylinder head cover is implemented through the screw-fastening by the bolts, a gap between the cylinder head cover and the engine cover is governed by the length of the bolts, and there has been difficulty in setting the gap between the cylinder head cover and the engine cover to a desired size.

As a method for mounting the engine cover to the cylinder head cover by any other method than the screw-fastening one, there is considered a method in which fixing portions are provided on a lower side of the engine cover and portions to be fixed which are formed into a corresponding shape to that of the fixing portions are provided on an upper side of the engine cover, whereby the fixing portions and the portions to be fixed are fixed to each other through engagement or the like, so that the engine cover is mounted to the cylinder head cover. According to this method, even in the event that hole-like fixing portions are provided on the lower side of the engine cover, since these fixing portions do not have to be opened in the upper side of the engine cover, it is considered that a risk can be avoided that the fixing portions become visible from above the engine cover, whereby the engine cover can provide superior design properties.

In the method like this, however, since the fixing portions cannot be viewed from above the engine cover, the positions of the fixing portions and the portions to be fixed cannot be confirmed also when the engine cover is attempted to be mounted to the cylinder head cover. Due to this, the positioning of the engine cover at the mounting position becomes difficult, leading to a problem that the working efficiency of mounting work is deteriorated. In particular, in a case where a number of fixing portions are mouted to a corresponding number of portions to be fixed, since the positioning of each portion to be fixed needs to be implemented relative to each fixing portion, the positioning of the engine cover at the mounting position becomes more difficult, leading to a problem that the working efficiency of mounting work is deteriorated further.

Furthermore, in this case, a space for engagement of the fixing portions with the portions to be fixed is required between the cylinder head cover and the engine cover. Thus, this makes it difficult to set the gap between the cylinder head cover and the engine cover to a desired size, leading to, for example, a problem that the engine cover cannot be mounted to a position close to the cylinder head cover. In the event that the gap between the cylinder head cover and the engine cover is not set to a desired size, there may be caused a problem that the transmitted noise from the engine is not sufficiently shielded by the engine cover.

SUMMARY OF THE INVENTION

The invention was made in consideration of the situations mentioned above and an object thereof is to provide an engine cover mounting structure which can facilitate the mounting of an engine cover to an engine member such as a cylinder head cover without damaging the design properties of the engine cover and which can sufficiently shield transmitted noise which leaks from an engine by setting a gap between the engine cover and the engine member to a desired size.

With a view to solving the problem, according to the invention, there is provided an engine cover mounting structure comprising an engine member having a plurality of portions to be fixed, and an engine cover having a cover body and a plurality of fixing portions which extend downwardly from the cover body and which are adapted to be mounted to the portions to be fixed, wherein a base fixing portion, which is one of the fixing portions, is supported a base portion to be fixed, which is one of the portions to be fixed, so as to revolve relative thereto.

Incidentally, the engine cover has a positioning portion which extends from the cover body and which is adapted to be brought into abutment with a surface of the engine member when the engine cover is mounted to the engine member, and when the engine cover revolves about the base fixing portion, so that the positioning portion is brought into abutment with the surface of the engine member in a state where the base fixing portion is mounted or temporarily mounted to the base portion to be fixed, while the other fixing portions are not mounted to the other portions to be fixed, the fixing portions other than the base fixing portion are disposed at positions facing the portions to be fixed other than the base portion to be fixed, respectively.

In addition, in the engine cover mounting structure according to the invention, a porous perforated member is laminated on at least a portion of the cover body which faces the cylinder head cover.

In the engine cover mounting structure according to the invention, the plurality of portions to be fixed are provided on the portion of the engine member which is situated below the upper surface of the cylinder head cover, and the fixing portions on the engine cover are fixed to the portions to be fixed. Consequently, a gap produced between the engine cover and the cylinder head cover when the engine cover is mounted to the engine member can be set to a desired size by the distance along which the fixing portions extend from the cover body, that is, the protruding height of the fixing portions. For example, in the event that the protruding height of the fixing portions is set small, the engine cover can be mounted so as to be close to the engine member, whereas in the event the protruding height of the fixing portions is set large, the engine cover can be mounted such that the engine cover is spaced apart from the cylinder head cover. Consequently, in the engine cover mounting structure according to the invention, the positions of the engine cover and the cylinder head cover can be set appropriately in accordance with the magnitude and frequency of transmitted noise which leaks from the engine, thereby making it possible to shield the transmitted noise in a more ensured fashion.

In addition, in the engine cover mounting structure according to the invention, since the engine cover is mounted to the engine member when the fixing portions are mounted to the portions to be fixed, there is no need to provide in the engine cover through holes for allowing the passage of bolts, which was the case with the related mounting structure, and hence the engine cover can provide superior design properties.

Additionally, in the engine cover mounting structure according to the invention, the base fixing portion provided on the engine cover is made to be supported on the base portion to be fixed which is provided on the engine member so as to revolve relative thereto. Then, when the engine cover is mounted to the engine member, in the event that the engine cover revolves about the base fixing portion, so that the positioning member is brought into abutment with the surface of the engine member in the state where the base fixing portion is mounted or temporarily mounted to the base portion to be fixed, while the other fixing portions are not mounted to the other portions to be fixed, the other fixing portions than the base fixing portion come to be disposed at the positions which face the other portions to be fixed than the base portion to be fixed, respectively. Due to this, in case the base fixing portion can be mounted to the base portion to be fixed, the positions where the other fixing portions are disposed are determined by the base fixing portion and the positioning portion, and the other fixing portions can easily be disposed at the positions which face the other portions to be fixed, respectively. Consequently, the mounting work can be implemented very easily.

In addition, in the engine cover mounting structure according to the invention, in the event that the porous perforated member is laminated on at least the portion of the cover body which faces the cylinder head cover, the transmitted noise that leaks from the engine can be shielded in a more ensured fashion.

DETAILED DESCRIPTION OF THE PREFERRED EMBODIMENTS

Figure 1:
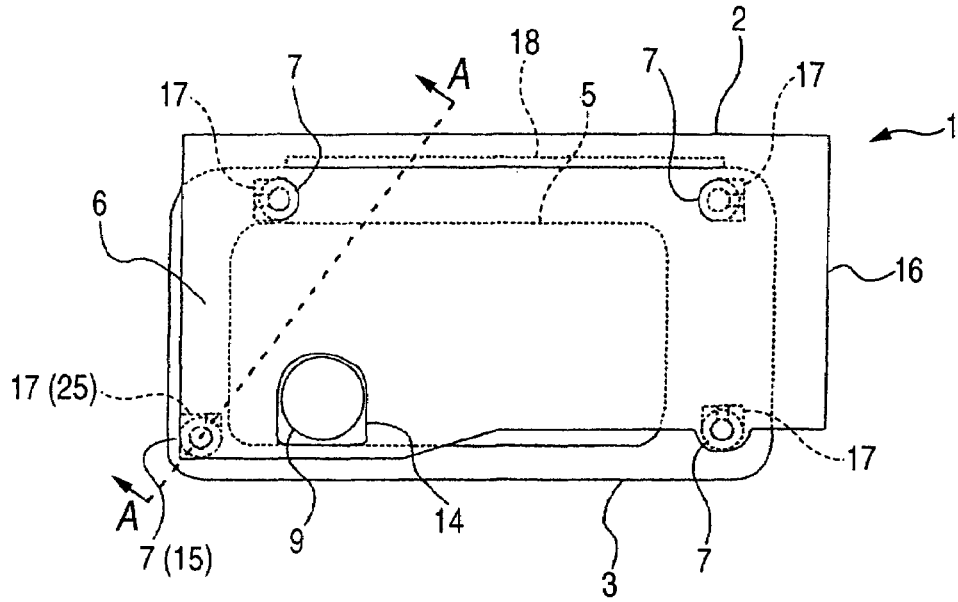
FIG. 1 is a plan view showing exemplarily an engine cover mounting structure according to an embodiment of the invention.

An engine cover mounting structure according to the invention includes an engine member and an engine cover which is held at an upper portion of the engine member.

The engine member means a generic designation of an engine main body made up of cylinders and pistons, a cylinder head cover which covers a cylinder head of the engine main body, a system for supplying the engine main body with fuel and air, a cam system for controlling inlet and exhaust of air, fuel or air-fuel mixture and exhaust gases, an oil circulating system and the like. In the invention, the engine cover is held on any part of the engine member and is disposed at an upper portion of at least part of the engine member. In the invention, the engine cover may be such as to cover only part of the engine member or may be such as to cover the whole of the engine member.

In the engine cover mounting structure of the invention, the engine member has a plurality of portions to be fixed which are situated below an upper surface of the cylinder head cover, and the engine cover has a plurality of fixing portions which extend downwardly from a substantially plate-like cover body. The portions to be fixed are portions to which the fixing portions on the engine cover are fixed, and the fixing portions are fixed by a normal method represented by, for example, fitting, engagement or the like. Consequently, in the engine cover mounting structure according to the invention, being different from the aforesaid related engine cover mounting structure, the screw-fastening by bolts is no more required when the engine cover is mounted to the engine member.

The numbers of the fixing portions and portions to be fixed may be any numbers as long as the numbers correspond to each other. As the number of the fixing portions and portions to be fixed increases, the engine cover is fixed to the engine member more rigidly, and as the number of the fixing portions and portions to be fixed decreases, the mounting work of the engine cover to the engine member becomes easier. The respective fixing portions may be formed into the same shape or different shapes. This is true with the portions to be fixed.

A positioning portion is provided on the engine cover in such a manner as to extend from the cover body. The positioning portion is a portion which is brought into abutment with a surface of the engine member, when the engine cover is mounted to the engine member, the shape of the positioning portion and position where the same portion is disposed are set appropriately in accordance with a position on the engine member with which the positioning portion is brought into abutment. The positioning portion may be brought into abutment with any surface of any member which makes up the engine member.

A base fixing portion, which is one of the fixing portion, is supported on a base portion to be fixed, which is one of the portions to be fixed, so as to revolve relative thereto. The base fixing portion and base portion to be fixed can be formed into any of existing shapes, and for example, the base portion to be fixed is formed into a rod-like shape, and a hole which allows for the insertion of the base portion to be fixed thereinto is provided in the base fixing portion, whereby the base fixing portion can be supported on the base portion to be fixed so as to revolve relative thereto.

In the engine cover mounting structure according to the invention, the engine cover is mounted to the engine member in accordance with the following procedure.

Firstly, a state is produced in which the base fixing portion of the fixing portions is supported on the base portion to be fixed so as to revolve relative thereto, while the other fixing portions remain detached from the portions to be fixed. As this occurs, the base fixing portion may be in a state in which the base fixing portion is completely mounted to the base portion to be fixed or may be in a temporarily mounted state in which the base fixing portion is not completely mounted to the base portion to be fixed. For example, in a case where the base fixing portion is formed into a rod-like shape, while a hole which allows for the insertion of the rod-like base fixing portion thereinto is provided in the base portion to be fixed, only a distal portion of the base fixing portion can be inserted into the base portion to be fixed to thereby produce the temporarily fixed state.

Next, in this state, the engine cover is revolved. When the positioning portion, which is part of the engine cover, revolves in association with the revolution of the engine cover, so that the positioning portion is brought into abutment with a surface of the engine member, the revolution of the engine cover is interfered and then stopped.

Since the fixing portions other than the base fixing portion on the engine cover are also part of the engine cover, the other fixing portions revolve in association with the revolution of the engine cover. Here, in the engine cover mounting structure according to the invention, when the engine cover revolves to such an extent that the positioning portion is brought into abutment with the surface of the engine member, the fixing portions other than the base fixing portion are disposed at positions which face the portions to be fixed other than the base portion to be fixed, respectively. Consequently, the mounting position of the engine cover can easily positioned by the positioning member, whereby the engine cover can easily be mounted to the engine member.

In the engine cover mounting structure according to the invention, a porous perforated member is preferably laminated on at least a portion of the cover body which faces the cylinder head cover. As this occurs, when the engine cover is mounted to the engine member, the porous perforated member is interposed in a gap produced between the cover body and the cylinder head cover. Due to this, transmitted noise that leaks from the engine is attenuated by the perforated member, whereby the transmitted noise can be shielded in an ensured fashion. As the perforated member used herein, existing perforated materials can be used which can absorb the energy of sound waves when the sound waves pass through voids thereof. For example, preferably used materials include, for example, a non-woven fabric of synthetic resin fiber properties formed from PET or the like, a non-woven fabric of natural fiber properties, a glass-wool laminate, a urethane foam, a formed olefin and the like.

An engine cover mounting structure according to the invention will be described below based on the drawings.

EMBODIMENT

Figure 2:
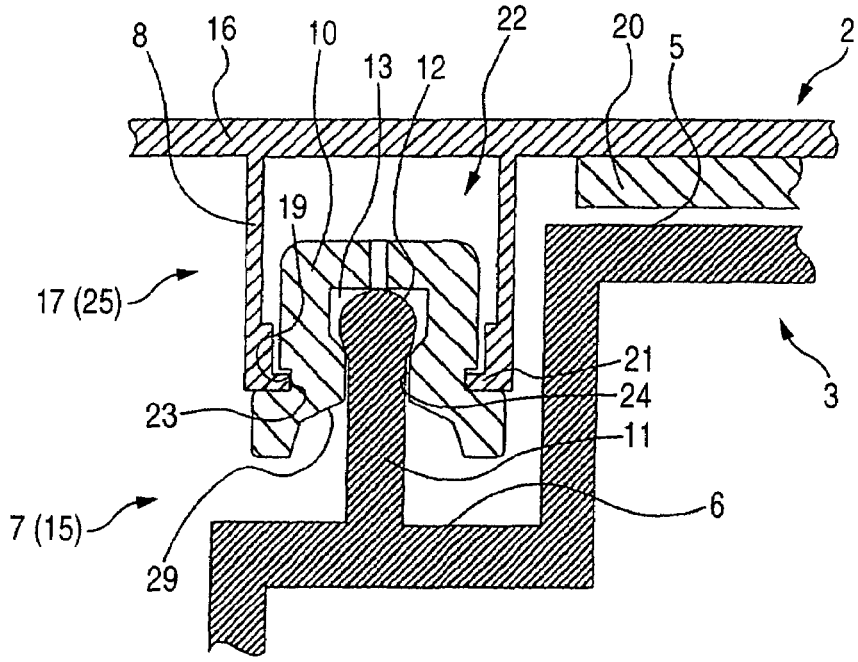
FIG. 2 is a sectional view taken along the line A-A in FIG. 1.
Figure 3:
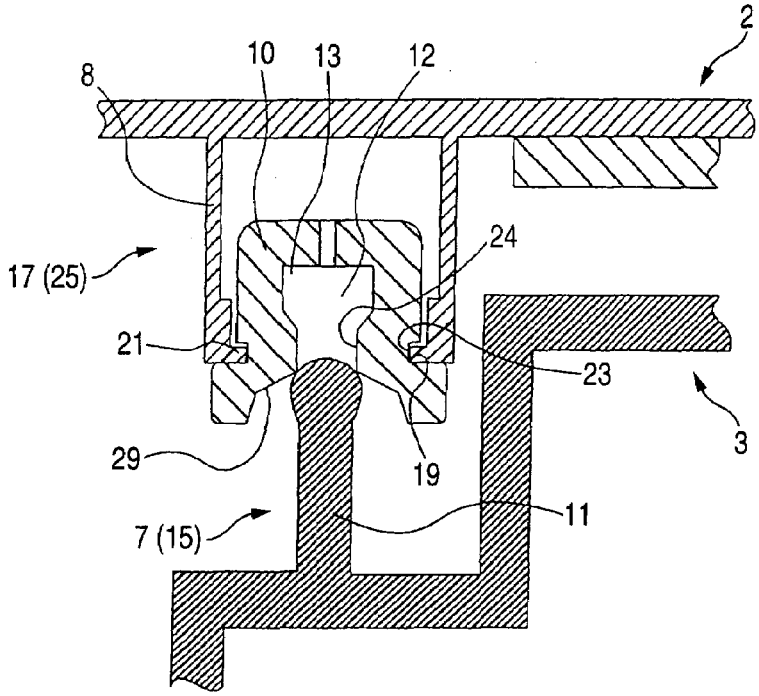
FIG. 3 is a sectional view taken along the line A-A in FIG. 1.
Figure 4:
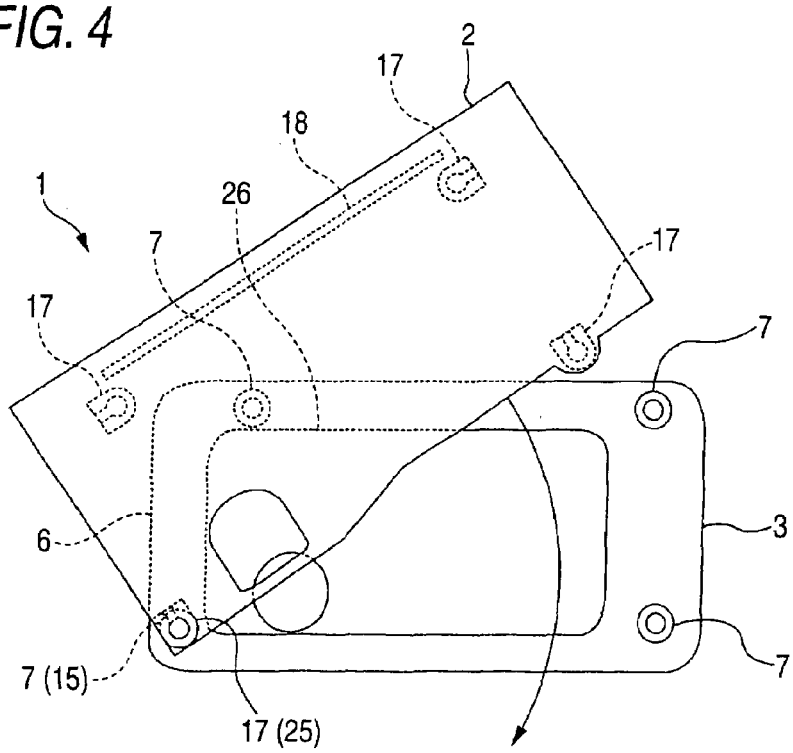
FIG. 4 is a plan view showing exemplarily an appearance in which an engine cover is mounted to an engine member in the engine cover mounting structure according to the embodiment.

A plan view showing exemplarily an engine cover mounting structure according to the invention is shown in FIG. 1, and sectional views taken along the line A-A in FIG. 1 are shown in FIGS. 2 and 3. In addition, in the engine cover mounting structure according to the embodiment, a plan view showing exemplarily an appearance of an engine cover mounted to an engine member is shown in FIG. 4.

In the engine cover mounting structure 1 of the embodiment, an engine cover 2 is mounted to a cylinder head cover 3 as an engine member.

The cylinder head cover 3 is formed into a substantially box-like shape which is opened downwardly. A lower stepped portion 6, which is lowered one stage in height, is formed circumferentially along an outer edge of an upper bottom portion 5 of the cylinder head cover 3. A protruding portion to be fixed 7, which extends upwardly, is provided on the lower stepped portion 6 at a position which corresponds to each of four corners of the cylinder head cover 3, and hence, in total, four such portions to be fixed are provided. An upper end of each portion to be fixed 7 is disposed below the upper bottom portion 5. In addition, each portion to be fixed 7 is formed into substantially the same shape. The portion to be fixed 7 has a leg portion 11 which extends upwardly from the lower stepped portion 6 and a diametrically expanded portion 12 which is formed at an upper end of the leg portion in such a manner as to have a larger diameter than that of the leg portion 11. Of the four portions to be fixed 7, the portion to be fixed 7 which is disposed in the left bottom corner of the lower stepped portion 6 shown in FIG. 1 constitutes a base portion to be fixed 15. In addition, a cap hole 14, whose diameter is larger than the contour of an oil cap 9 attached to the cylinder head cover 3, is formed in the engine cover 2 at a position which faces the oil cap 9 in such a manner as to penetrate the engine cover 2. The base fixing portion 25 is provided in the vicinity of the cap hole 14.

The engine cover 2 has a flat plate-like cover body 16, four fixing portions 17 which extend downwardly from four corners of the cover main body, respectively, and a vertical wall-like positioning portion 18 which extends downwardly from a deep or far side of the cover body 16. In addition, a perforated material 20 made up of anon-woven fabric formed from PET is laminated on a lower surface side of the cover body 16.

Each fixing portion 17 is made up of a frame portion 8 which is formed into a tube of a substantially U-shape in cross section which has an interior hollow and which is opened in one side thereof and a bag-like cap 10 held in the interior hollow in the frame portion 8. A wall-like bottom wall 21 is provided at a lower end portion of the frame portion 8, and a keyhole-like holding groove 23 is formed in the bottom wall 21 in such a manner as to communicate with an opening 22 in the one side. The cap 10 held in the hollow interior in each frame portion 8 has an external shape whose diameter is lager than the key hole-like holding groove 23 in the frame portion 8 and is press fitted into the interior hollow from the opening 22. The cap 10 has an interior hollow 13 having a shape which corresponds to an external shape of the portion to be fixed 7 and is formed into a shape which is constricted at a substantially intermediate stepped portion in an axial direction thereof. At this constricted portion, a cap-side holding groove 19 is formed on an external surface side of the cap 10 where an external surface of the cap 10 sinks towards an inner circumferential side thereof and a diametrically contracted portion 24 is formed on an internal surface side of the cap 10 where an internal surface of the cap 10 rises towards the inner circumferential side thereof. This cap 10 is made of elastic member such as rubber and hence deforms elastically so as to be expanded and contracted diametrically. The diameter of the holding groove 23 in the frame portion 8 is made larger than the external shape of the portion to be fixed 7 and is made smaller than the external shape of the cap 10. The cap 10 is held in the frame portion 8 at a position where the cap-side holding groove 19 is brought into abutment with the holding groove 23. Furthermore, a portion on the internal surface side of the cap 10 which is below the diametrically constricted portion 24 forms a conical tapered surface 29.

Of the four fixing portions 17, the fixing portion 17 which is disposed in the left bottom corner shown in FIG. 1 constitutes a base fixing portion 25. A frame portion 8 of the base fixing portion 25 and a frame portion 8 of the fixing portion 17 which is disposed in the right bottom corner in FIG. 1 are opened on a deeper or farther side thereof. In addition, a frame portion 8 of the fixing portion 17 which is disposed in the left top corner in FIG. 1 is opened in a left-hand side thereof, and a frame portion 8 of the fixing portion 17 which is disposed in the right top corner in FIG. 1 is opened in a right-hand side thereof.

In the mounting structure 1 of the engine cover 2 according to the embodiment of the invention, the mounting of the engine cover 2 to the cylinder head cover 3 was implemented as below.

Firstly, the engine cover 2 was pressed against the cylinder head cover 3 from thereabove, and as shown in FIG. 3, a distal end of the base portion to be fixed 15 was temporarily mounted in such a manner as to be in abutment with a tapered surface 29 of the cap 10 by lightly inserting the distal end of the base portion to be fixed 15 into a lower end of the interior hollow 13 in the cap 10 held in the base fixing portion 25. As this occurred, since the distal end of the base portion to be fixed 15 was disposed below the diametrically constricted portion 24 of the cap 10, the base fixing portion 25 was supported on the base portion to be fixed 15 so as to revolve thereto.

Next, with the base fixing portion 25 being temporarily mounted to the base portion to be fixed 15, the engine cover 2 was revolved in a direction indicated by an arrow in FIG. 4. In association with the revolution of the engine cover 2, the positioning portion 18 revolved, and when the positioning portion 18 was brought into abutment with a side of the cylinder head cover 3 situated on a deeper or farther side thereof, the revolution of the engine cover 2 was interfered and stopped by virtue of the abutment. As this occurred, as shown in FIG. 1, the fixing portions 17 other than the base fixing portion 25 (hereinafter, referred to as the general fixing portions) were disposed at positions which face the portions to be fixed 7 other than the base portion to be fixed 15 (hereinafter, referred to as the general portions to be fixed), respectively. In this state, when the engine cover 2 was pressed downwardly, that is, in a direction towards the cylinder head cover 3, the portions to be fixed 7 were, as shown in FIG. 2, inserted into the fixing portions 17, respectively, whereby the engine cover 2 was mounted to the cylinder head cover 3.

According to the mounting structure 1 of the engine cover 2 of the embodiment, the mounting position of the engine cover 2 to the cylinder head cover 3 is easily positioned by the positioning portion 18. Due to this, the mounting work of the engine cover 2 to the cylinder head cover 3 can be implemented very easily. In addition, since there is provided no through hole in the engine cover 2, the engine cover 2 provides superior design properties.

In addition, since the portions to be fixed 7 are disposed below the upper bottom portion 5 of the cylinder head cover 3, the fixing portions 17 and the portions to be fixed 7 are mounted to each other below the upper surface of the cylinder head cover 3. Consequently, the engine cover 2 can be mounted to the position close to the cylinder head cover 3, whereby the transmitted noise that leaks from the engine can be shielded in a more ensured fashion.

Furthermore, since the perforated material 20 is laminated on the lower surface side of the cover body 16, that is, on the portion of the cover body 16 which confronts the cylinder head cover 3, the transmitted noise that leaks from the engine can be shielded in a more ensured fashion.

Furthermore, since the base fixing portion 25 is provided in the corner of the engine cover 2, so that the fixing portion 25 is temporarily mounted to the base portion to be fixed 15 with ease, the mounting work of the engine cover 2 to the cylinder head cover 3 can be facilitated further.

Then, the through hole-like cap hole 14 is provided in the engine cover 2 at the position which corresponds to the oil cap 9 attached to the cylinder head cover 3, and the base fixing portion 25 is provided in the vicinity of the cap hole 14. Due to this, at the time of implementing a temporary mounting, the positions of the base fixing portion 25 and the base portion to be fixed 15 can be indexed using the positions of the oil cap 9 and the cap hole 14 as reference marks, and in addition, since the temporary mounting can be implemented while confirming the position of the base portion to be fixed 15 from the cap hole 14, the mounting work of the engine cover 2 to the cylinder head cover 3 can be facilitated further.

Figure 5:
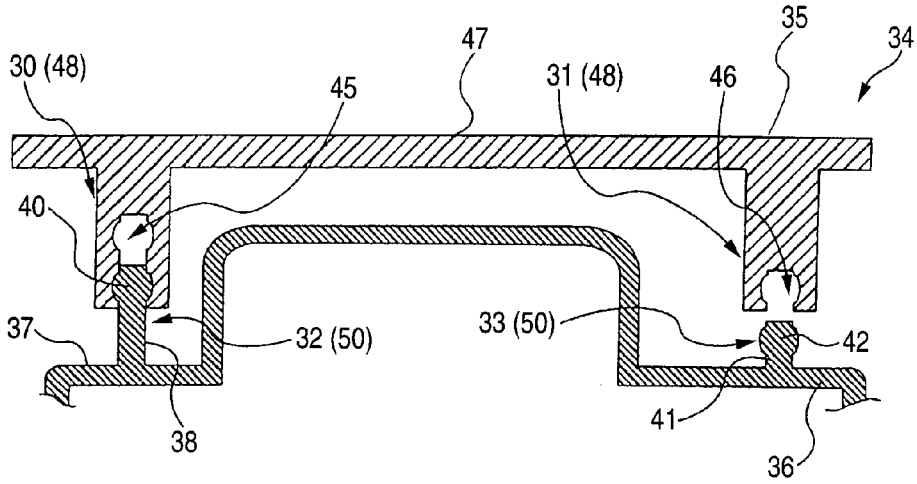
FIG. 5 is a sectional view showing exemplarily fixing portions and portions to be fixed which are formed into another shape in the engine cover mounting structure according to the embodiment.
Figure 6:
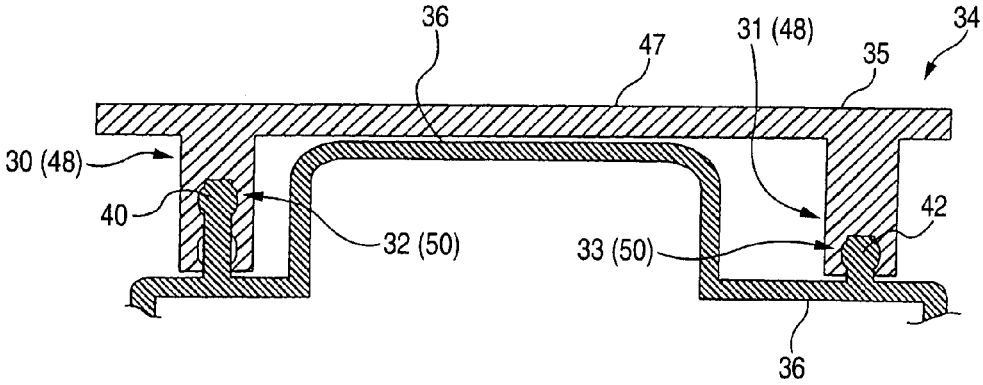
FIG. 6 is a sectional view showing exemplarily the fixing portions and portions to be fixed which are formed into another shape in the engine cover mounting structure according to the embodiment.

Note that while in the embodiment, the respective fixing portions 17 and the respective portions to be fixed 15 are formed into substantially the same shapes, respectively, for example, as shown in FIGS. 5 and 6, the shape of a base fixing portion 30 may be differentiated from the shape of general fixing portions 31, and the shape of a base portion to be fixed 32 may be differentiated from the shape of general portions to be fixed 33 for temporary mounting of the base fixing portion 30 to the base portion to be fixed 32. In an engine cover mounting structure shown in FIGS. 5 and 6, the base portion to be fixed 32 is formed into a protruding shape having a stem portion 38 which extends upwardly from a lower stepped portion 37 of a cylinder head cover 36 and a base diametrically expanded portion 40 which constitutes a distal end of the stem portion 38 and which is diametrically expanded to be larger in diameter than the stem portion 38. Then, the general portion to be fixed 33 has a stem portion 41 which is shorter than the base portion to be fixed 32 and a general diametrically expanded portion 42 which is situated below the base diametrically expanded portion 40. In addition, in the engine cover mounting structure 34, the base fixing portion 30 and the general fixing portions 31 are formed into substantially tubular shapes having interior hollows, respectively. An interior hollow 45 in the base fixing portion 30 are expanded in diameter so as to be formed into a shape corresponding to an external shape of the base diametrically expanded portion 40 at a position corresponding to a position where the base diametrically expanded portion 40 is disposed therein in a height direction thereof and a position corresponding to a position where the general diametrically expanded portion 42 is disposed therein in a height direction thereof. An interior hollow 46 in the general fixing portion 31 is expanded in diameter in a similar fashion at a position corresponding to a position where the general diametrically expanded portion 42 is disposed therein in a height direction thereof.

In mounting this engine cover 35 to the cylinder head cover 36, firstly, the base portion to be fixed 32 is press fitted in the base fixing portion 30. When the base diametrically expanded portion 40 of the base portion to be fixed 32 is inserted to the lower diametrically expanded portion in the interior hollow 45 in the base fixing portion 30, the base fixing portion 30 is temporarily mounted to the base portion to be fixed 32, whereby the base fixing portion 30 can be revolved about the base portion to be fixed 32. Then, the engine cover 35 is revolved in that state, so that the general fixing portions 30 are positioned at positions which face the general portions to be fixed 33, respectively, and the engine cover 35 is then pressed downwardly. As this occurs, the base diametrically expanded portion 40 of the base portion to be fixed 32 is press fitted into the upper diametrically expanded portion in the interior hollow 45 in the base fixing portion 30, and the general diametrically expanded portions 42 of the general portions to be fixed 33 are press fitted into the diametrically expanded portions in the interior hollows 46 in the general fixing portions 31, whereby respective fixing portions 48 can be mounted to respective portions to be fixed 50 as shown in FIG. 6.

Figure 7:
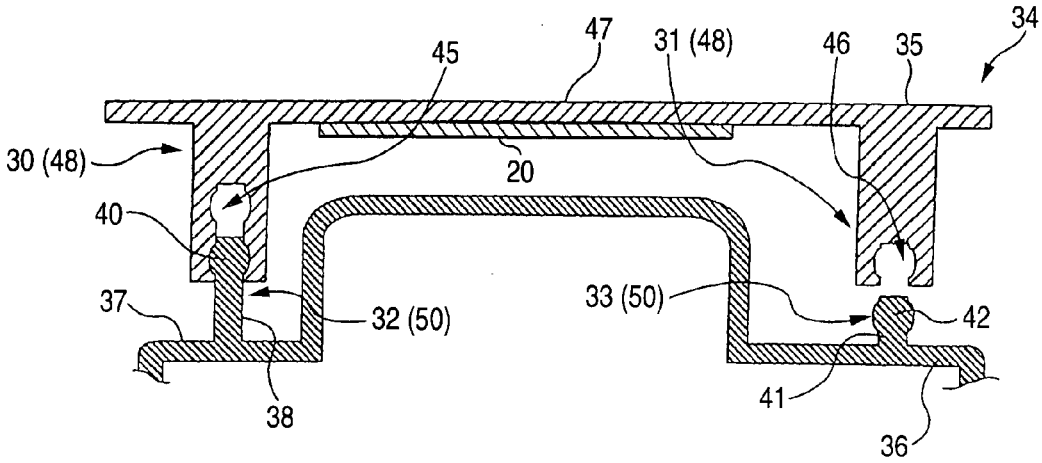
FIG. 7 is a sectional view showing exemplarily fixing portions and portions to be fixed which are formed into the other shape in the engine cover mounting structure according to the embodiment.

Further, the perforated material 20 can be laminated on the portion of the cover body 47 which confronts the cylinder head cover 36, as shown in FIG. 7. According thereto, the transmitted noise that leaks from the engine can be shielded in a more ensured fashion.

Also according to the engine cover mounting structure 34 having the base fixing portion 30, the base portion to be fixed 32, the general fixing portions 31 and the general portions to be fixed 33 which are formed into the shapes as described above, a similar advantage to that obtained by the aforesaid embodiment can be obtained.

What is claimed is:

1. An engine cover mounting structure comprising:

an engine member having a first plurality of coupling members; and an engine cover having a cover body and a second plurality of coupling members, wherein the coupling members of the second plurality are joined to the cover body, move together with the cover body, extend downwardly from the cover body and are adapted to be mounted to the coupling members of the first plurality when the engine cover is mounted to the engine, and one of the coupling members of the first plurality is a first base coupling member, and one of the coupling members of the second plurality is a second base coupling member, and the first base coupling member is adapted to couple with the second base coupling member such that the second base coupling member revolves with respect to the first base coupling member, wherein a porous member is disposed on at least a portion of the cover body that faces a cylinder head cover.

2. The engine cover mounting structure according to claim 1, wherein the engine cover has a positioning portion which extends from the cover body and which is adapted to be brought into abutment with a surface of the engine member when the engine cover is mounted to the engine member; and the engine cover is adapted to revolve about the first base coupling member, so that the positioning portion is brought into abutment with the surface of the engine member in a state where the first base coupling member is mounted or temporarily mounted to the second base coupling member, while the other coupling members of the second plurality are not mounted to coupling members of the first plurality, and so that the coupling members of the second plurality, other than the second base coupling member, are located at positions facing corresponding coupling members of the first plurality.

3. The engine cover mounting structure according to claim 1, wherein the second base coupling member is provided in the corner of the engine cover.

4. An engine cover mountina structure comprising:

an engine member having a first plurality of coupling members; and an engine cover having a cover body and a second plurality of coupling members, wherein the coupling members of the second plurality are joined to the cover body, move together with the cover body, extend downwardly from the cover body and are adapted to be mounted to the coupling members of the first plurality when the engine cover is mounted to the engine, and one of the counping members of the first plurality is a first base coupling member, and one of the coupling members of the second plurality is a second base coupling member, and the first base coupling member is adapted to couple with the second base coupling member such that the second base coupling member revolves with respect to the first base counpling member, wherein the engine cover has a through hole-like cap hole, and the second base coupling member is provided in the vicinity of the cap hole.

5. The engine cover mounting structure according to claim 4, wherein the cap hole is provided at a position that corresponds to an oil cap attached to a cylinder head cover.

6. The engine cover mounting structure according to claim 1, wherein the shape of the second base coupling member differs from the shape of the other coupling members of the second plurality and is temporarily mountable.

7. An engine cover mounting structure comprising:

an engine member having a first plurality of coupling members; and an engine cover having a cover body and a second plurality of coupling members, wherein the coupling members of the second plurality are joined to the cover body, move together with the cover body, extend downwardly from the cover body and are adapted to be mounted to the coupling members of the first plurality when the engine cover is mounted to the engine, and one of the coupling members of the first plurality is a first base coupling member, and one of the coupling members of the second plurality is a second base coupling member, and the first base coupling member is adapted to couple with the second base coupling member such that the second base coupling member revolves with respect to the first base coupling member, wherein each of the second base coupling members comprises:

a frame portion which has an interior hollow and which is opened in one side thereof; and a bag-like cap held in the interior hollow in the frame portion, wherein a diametrically contracted portion is formed on an internal surface side of the cap.

8. The engine cover mounting structure according to claim 7, wherein the cap is made of elastic material.

9. The engine cover mounting structure according to claim 8, wherein the cap has a conical tapered surface.

10. The engine cover mounting structure according to claim 9, wherein the conical tapered surface is formed below the diametrically contracted portion.

11. The engine cover mounting structure according to claim 1, wherein each coupling member of the first plurality comprises:

a leg portion which extends upwardly from the engine member; and a diametrically expanded portion which is formed at an upper end of the leg portion and has a larger diameter than that of the leg portion.

12. The engine cover mounting structure according to claim 1, wherein each coupling member of the second plurality has an interior hollow.

13. An engine cover mounting structure comprising:

an engine member having a first plurality of coupling members; and an engine cover having a cover body and a second plurality of coupling members, wherein the coupling members of the second plurality are joined to the cover body, move together with the cover body, extend downwardly from the cover body and are adapted to be mounted to the coupling members of the first plurality when the engine cover is mounted to the engine, and one of the coupling members of the firt plurality is a first base coupling member, and one of the coupling members of the second plurality is a second base coupling member, and the first base coupling member is adapted to couple with the second base coupling member such that the second base coupling member revolves with respect to the first base coupling member, wherein each coupling member of the first plurality includes a stem portion which extends upwardly from a lower stepped portion and a diametrically expanded portion, which is formed at an upper end of the stem portion, and the diametrically expanded portion has a larger diameter than that of the stem portion; and the second base coupling member has at least two interior hollows, which are spaced apart, and each hollow is adapted to accommodate the diametrically expanded portion of the first base coupling member.

14. The engine cover mounting structure according to claim, 4 wherein the engine cover has a positioning portion which extends from the cover body and which is adapted to be brought into abutment with a surface of the engine member when the engine cover is mounted to the engine member; and the engine cover is adapted to revolve about the first base coupling member, so that the positioning portion is brought into abutment with the surface of the engine member in a state where the first base coupling member is mounted or temporarily mounted to the second base coupling member, while the other coupling members of the second plurality are not mounted to coupling members of the first plurality, and so that the coupling members of the second plurality, other than the second base coupling member, are located at positions facing corresponding coupling members of the first plurality.

15. The engine cover mounting structure according to claim 4, wherein the second base coupling member is provided in the corner of the engine cover.

16. The engine cover mounting structure according to claim 4, wherein the shape of the second base coupling member differs from the shape of the other coupling members of the second plurality and is temporarily mountable.

17. The engine cover mounting structure according to claim 4, wherein each coupling member of the first plurality comprises:

a leg portion which extends upwardly from the engine member; and a diametrically expanded portion which is formed at an upper end of the leg portion and has a larger diameter than that of the leg portion.

18. The engine cover mounting structure according to claim 4, wherein each coupling member of the second plurality has an interior hollow.

* * * * *